United States Patent [19]

Meserve

[11] 4,439,256

[45] Mar. 27, 1984

[54] METHOD OF PRODUCING FLAT STRANDED MAGNETIC CONDUCTOR CABLE

[75] Inventor: Robert F. Meserve, Lisbon, N.H.

[73] Assignee: New England Electric Wire Corporation, Lisbon, N.H.

[21] Appl. No.: 235,706

[22] Filed: Feb. 18, 1981

[51] Int. Cl.[3] ..... H01B 13/00

[52] U.S. Cl. ..... 156/50; 29/469.5; 29/745; 29/825; 57/216; 57/217; 72/276; 72/278; 174/34; 174/113 A; 174/117 F; 174/117 FF; 174/129 R

[58] Field of Search ..... 29/469.5, 745, 825; 57/212, 213, 215, 216, 217, 233; 156/50; 174/34, 113 A, 117 F, 117 FF, 129 R; 72/276, 278

[56] References Cited

U.S. PATENT DOCUMENTS

| | | | |
|---|---|---|---|
| 587,764 | 8/1897 | Short . | |
| 715,313 | 12/1902 | Spaulding . | |
| 1,209,096 | 12/1916 | Williamson . | |
| 1,943,086 | 1/1934 | McKnight | 173/264 |
| 1,943,087 | 1/1934 | Potter | 173/264 |
| 2,938,821 | 5/1960 | Nack | 154/2.24 |
| 2,973,552 | 3/1961 | Downing et al. | 18/13 |
| 2,978,530 | 4/1961 | Braeckman | 174/34 |
| 3,288,916 | 11/1966 | Koon | 174/116 |
| 3,457,718 | 7/1969 | Otto et al. | 57/215 X |
| 3,501,728 | 3/1970 | Barriball | 336/155 |
| 3,516,859 | 6/1970 | Gerland et al. | 117/218 |
| 3,659,038 | 4/1972 | Shealy | 57/215 X |
| 3,681,510 | 8/1972 | Lemieux | 174/23 |
| 3,687,748 | 8/1972 | Clock et al. | 156/56 |
| 3,823,542 | 7/1974 | Pemberton | 57/161 |
| 3,872,660 | 3/1975 | Gallagher-Daggitt | 57/58.3 |

*Primary Examiner*—Robert A. Dawson

[57] ABSTRACT

A cable comprised of coated conductors, wound together and compacted, has an insulating strip interposed between the two layers in which the conductors are disposed, to ensure good insulation therebetween. Apparatus for producing the cable includes a stranding machine, with which a hollow mandrel is used for the purpose of introducing the insulating strip between the layers of conductors, and a method for producing the cable is also provided.

2 Claims, 11 Drawing Figures

METHOD OF PRODUCING FLAT STRANDED MAGNETIC CONDUCTOR CABLE

BACKROUND OF THE INVENTION

To maximize conductor and turn density, the wire used in electrical inductors, transformers and the like may advantageously have a flat, rectangular cross-section, such as may be formed by compacting a cable (e.g., Litz cable) composed of a number of insulated conductors that have been helically wound together. The helical configuration of the conductors causes each to assume all positions within the cross-section of the cable, thus minimizing eddy current losses and skin effects that would otherwise be produced. While interstrand insulation is readily provided by the use of organic coatings upon the individual conductors, the mechanical compaction involved in manufacturing the flat cable tends to damage the coating, thereby reducing integrity and ultimately causing power losses in the machine in which the cable is used.

Accordingly, it is a primary object of the present invention to provide a novel multi-conductor cable of flat, rectangular cross-section, in which the conductors are helically wound together and compacted into two layers, with the individual conductors as well as the layers thereof being well insulated from one another.

It is a more specific object of the invention to provide such a cable, in which a thin strip of insulating sheet material is interposed between the layers of conductors, to ensure that a high degree of electrical insulation is provided therebetween.

It is also an object of the invention to provide a novel method and apparatus by which cable of the foregoing description can readily be produced.

SUMMARY OF THE INVENTION

It has now been found that certain of the foregoing and related objects of the invention are readily attained in a cable comprised of at least four conductors coated with a dielectric organic material, and an insulating strip of sheet material interposed therebetween. The conductors are helically wound together and are compacted to a flat, generally rectangular cross-section, and they are disposed substantially in two layers; the strip of sheet material is interposed between the layers of conductors. Thus, electrical insulation is provided between the layers, as well as between the individual conductors.

The member of conductors in the cable will not usually exceed 48, and generally they will have a core of copper or aluminum. Ideally, the conductors will be so packed as to provide less than about 15 percent of void space in the cable.

Other objects of the invention are attained in apparatus for manufacturing the cable described, which apparatus includes, as one essential feature, rotatable means for continuously supplying to a forming station at least four longitudinally advancing conductors disposed in a generally circular array. An elongated mandrel is fixedly positioned at the forming station, and is disposed substantially on the axis of the circular array of conductors. The mandrel has an axial bore extending through it, and it has a leading end portion of circular cross-section, a trailing end portion of flat eliptical cross-section, and a transition portion therebetween. Means is provided in the apparatus for urging the conductors against the mandrel and into conformity therewith, and additional means is provided for continuously supplying a strip of dielectric sheet material to the mandrel for advancement through its bore and into position among the conductors. Adjacent the following end portion of the mandrel, means is provided for compacting the conductors into a dense, flat, generally rectangular cross-sectional configuration in which the conductors are disposed substantially in two layers, with the strip of sheet material interposed therebetween. Finally, the apparatus includes means for continuously advancing the wires and the strip, for taking-up the cable so produced, and for driving the supplying means and the advancing and taking-up means. The means for urging the conductors against the mandrel will generally comprise a stationary die, which cooperates with the mandrel to provide an annular space through which the conductors must pass, and the means for compacting the conductors will normally comprise a set of turkshead roller dies.

Additional objects of the invention are provided by a method for manufacturing the cable, in which a longitudinally advancing and rotating, generally circular array of at least four coated conductors is continuously supplied to a forming station. At the forming station, the conductors are formed into a helical configuration of generally circular cross-section, and are thereafter transformed into a flat, eliptical cross-sectional configuration. A strip of insulating sheet material is longitudinally fed into the center of the array of conductors, and the conductors are then compacted tightly about the insulating strip, thus transforming the eliptical structure into a cable of generally rectangular cross-section, which is continuously withdrawn from the forming station. In the cable, the conductors are disposed substantially in two layers, with the strip interposed therebetween, and they are densely packed, preferably with less than about 15 percent of void space in the cable.

DETAILED DESCRIPTION OF THE ILLUSTRATED EMBODIMENTS

Figures 1, 2, 3:
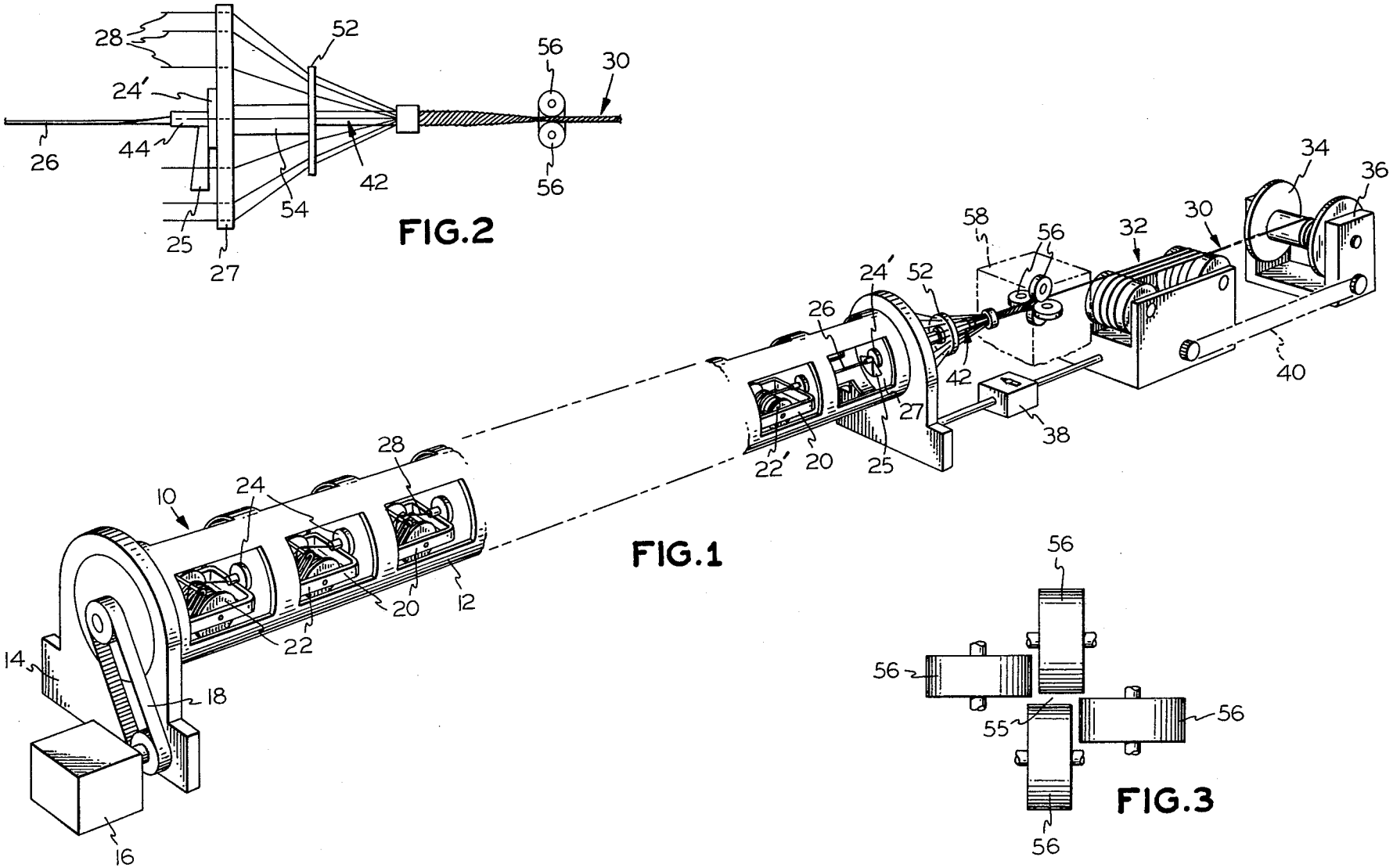
FIG. 1 is a diagrammatical, fragmentary perspective view of a system embodying the apparatus of the present invention.
FIG. 2 is a fragmentary elevational view of the forming station of the system of FIG. 1, drawn to an enlarged scale.
FIG. 3 is an end view of the turkshead roller die set utilized in the system of FIG. 1, drawn to a scale that is further enlarged from that of FIG. 2.
Figure 4:
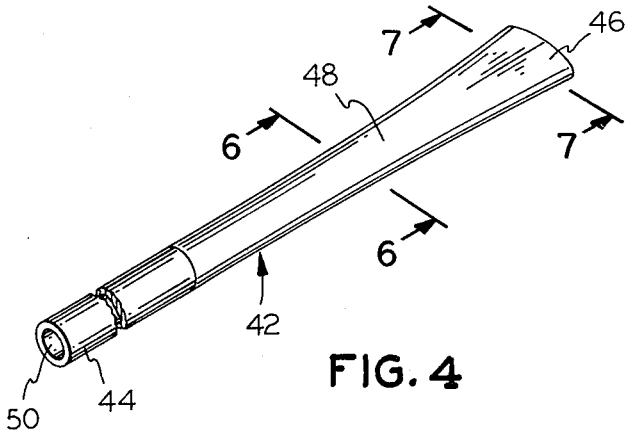
FIG. 4 is a perspective view of the core-pin or mandrel utilized in the apparatus, drawn to a scale that is greatly enlarged from that of FIG. 1.
Figure 5:
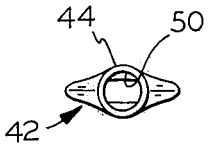
FIG. 5 is an elevational view showing the leading end of the core-in of FIG. 4.

Turning now in detail to FIG. 1 of the appended drawings, therein illustrated is a system embodying the apparatus of the present invention, and including a conventional tubular stranding machine, generally designated by the mandrel 10. The machine 10 consists of a cylindrical body 12, which is journaled in end bearings 14 and is rotated by the motor 16 through the drive belt 18. Disposed within compartments spaced along the length of the body 12 are a number of cradles 20, each of which rotatably mounts a supply reel 22; the cradles 20 are themselves supported by bearing assemblies 24, permitting them to remain stationary while the body 12 rotates about them. With the exception of the forward-most reel 22', which contains a supply of narrow strip or tape 26 of synthetic resinous sheet material, each of the reels 22 holds a supply of insulated metal wire 28. A stabilizing weight 25 is affixed to the bearing assembly 24' mounted in the end plate 27, and serves to maintain the rotationally fixed position of the core-pin, which will be described in greater detail hereinbelow. As is normally the case in machines of this sort, the wire played off from each of the reels 22 passes into the associated bearing assembly 24 and then radially outwardly to the body 12. The body is provided with appropriately positioned stationary guides (not shown) through which the individual wires 28 pass to the forward end of the machine 10. There they are combined and twisted into a cable, generally designated by the numeral 30, at a forming station of the system, which will also be described in detail hereinbelow. FIG. 1 is, of course, a foreshortened view of the machine 10; as will be appreciated, in actuality it will have compartments and cradles 20 sufficient to mount the number of supply reels 22 necessary to provide as many strands 28 of the wire as may be desired in the ultimate cable 30.

The individual wires 29 and the strip 26 are drawn through the machine 10 and the forming station of the system by a haul-off capstan, generally designated by the numeral 32; the finished cable 30 is withdrawn therefrom and wound upon a take-up reel 34, journaled in a stand 36. Motivating force for the capstan 32 is taken from the machine motor 16 through a transmission, including an adjustable gear box 38. The take-up reel 34 is, in turn, driven from the capstan 32 through the drive chain 40.

With more specific reference now to FIGS. 2 and 4 through 9 of the drawings, a unique and essential feature of the apparatus is the hollow core-pin or mandrel, provided at the forming station and generally designated by the numeral 42. The leading or inlet end portion 44 of the core-pin 42 is of circular cross-section, the trailing or outlet end portion 46 is of flat, eliptical cross-section, and a gradual transition portion 48 is provided therebetween. The core-pin 42 has an axially extending throat or bore 50, which has a varying cross-sectional configuration corresponding to that of the exterior surface.

As is best seen in FIG. 2, a circular stranding plate 52 is rigidly attached to the machine end plate 27 by a tubular connector 54, through which passes the circular leading end portion end 44 of the core-pin 42; consequently, the stranding plate 52 and the end plate 27 (which is attached to the cylindrical body 12) rotate in tandem when the body 12 is rotated during operation of the machine 10. A stranding die 54 is supported (by means not shown) forwardly of the stranding plate 52, and has a passageway of circular cross-section providing, in cooperation with the core-pin 42, an annular space through which the wires 28 pass. Thus, after passing through the end plate 27, the wires 28 are constrained in a circular array by the stranding plate 52, and are thereafter further constrained and transformed from a reduced diameter circular cross-section to one of flat, eliptical configuration. Because the array is moving rotationally as well as longitudinally at the point of engagement upon the core-pin 42, the conductors are twisted upon one another into a helical configuration, which is preserved during transformation of the structure to the eliptical cross-section; since the cradles 22 do not rotate with the body 12 of the machine 10, no twisting of the individual wires 28 about their own axes occurs.

Figure 8:
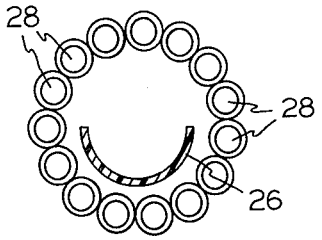
FIG. 8 is a cross-sectional view of the forming station of the system of FIG. 1, taken at the point of initial contact of the conductors upon the core-pin, but eliminating the core-pin for clarity of illustration.
Figure 6:
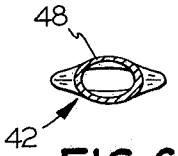
FIG. 6 is a cross-sectional view taken along line 6—6 in FIG. 4.
Figure 9:
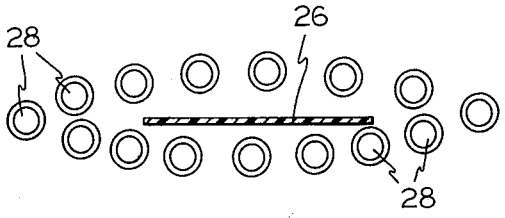
FIG. 9 is a cross-sectional view similar to that of FIG. 8 and drawn to the scale thereof, taken at about the location of line 7—7 of FIG. 4, and exaggerating the spacing between individual conductors, again for the sake of clarity.
Figure 7:
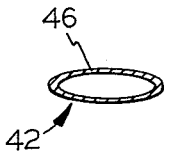
FIG. 7 is a cross-sectional view taken along line 7—7 in FIG. 4.

At the same time that the wires 28 are fed from the reels 22, the tape 26 of plastic material is being withdrawn from its reel 22' and passed through the throat 50 of the core-pin 42. As seen in FIGS. 8 and 9, the tape 26 assumes a generally semi-circular configuration at the leading end of the pin, and is transformed to a substantially flat condition at the trailing end thereof. It will be appreciated that, upon passage beyond the core-pin 42, the wires 28 will be disposed substantially in two layers, with the tape 26 interposed therebetween and within the array thereof.

Figure 10:
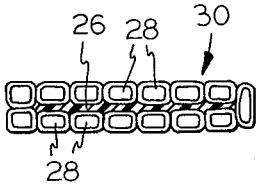
FIG. 10 is a cross-sectional view of the cable of the invention, that may be produced by the method and apparatus thereof.
Figure 11:
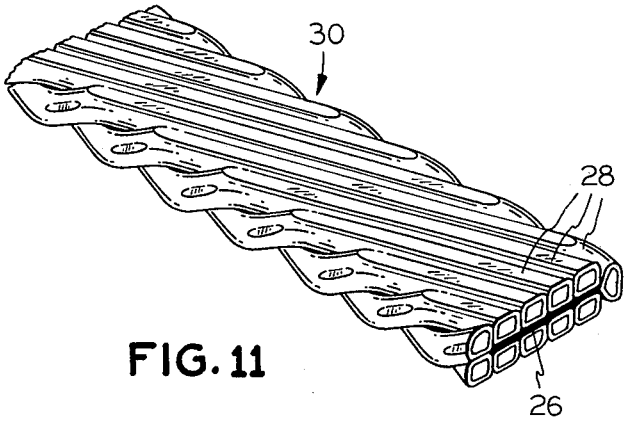
FIG. 11 is a perspective view of a piece of the cable of FIG. 10, drawn to an enlarged scale.

At a downstream point directly adjacent the core-pin 42, the composite of the wires and tape enters the rectangular nip 55 formed by the set of four turkshead rollers 56 (best seen in FIG. 3), which are rotatably supported by appropriate structure 58, shown diagrammatically in FIG. 1. The composite structure is thereby compacted to form the ultimate cable 30, shown in greatest detail in FIGS. 10 and 11. As can be seen, the individual wires or strands 28 are twisted together into a helical configuration of flat, rectangular cross-section, consisting substantially of two layers between which the strip 26 is interposed. Each wire 28 is therefore disposed in all possible cross-sectional positions within the cable 30, thereby providing the desirable electrical properties referred to hereinabove. The strip 26 provides insulation between the layers, thereby compensating for any loss of integrity in the wire coating insulation caused by compaction of the wires, and providing an added measure of control over the electrical charcteristics of the final product.

In general, standard magnet wire, consisting of a solid core coated with an organic insulating material, will normally be employed to produce the cable, albeit that multi-strand cores may also be used beneficially. In any event, the core will usually be made of copper or aluminum; the insulation may be provided by any natural or synthetic organic dielectric resinous material conventionally used for wire coating purposes, exemplary of which are polyurethane, polyester, polyimide, nylon, polyvinyl formal, varnish, and the like, and it will be appreciated that copolymers and interpolymers, as well as multilayer composite coatings, may be suitable and are encompassed. The potential application and frequency requirements for the cable will dictate the size and number of component conductors. Generally, gauge sizes ranging from 36 to 12 will be suitable, depending of course upon whether the wire is solid or of multi-strand construction. While the number of conductors may range from 4 to 48 (or possibly more, in certain instances), most typically the cable will be composed of 7 to 15 wires. The insulation on the wires will normally be about one-half to two mils thick, again depending upon the gauge of the core.

The strip of insulating sheet material may be fabricated from any of the foregoing or similar resinous dielectrics; it may alternatively be made of a suitable paper or glass web insulation. The thickness of the strip will usually be about one to ten mils, and its width will vary depending again upon the dimensions of the conductors employed. As a convenient rule of thumb, however, the width of the strip may approximate the value of (n-2)/2, times the wire diameter, where "n" equals the number of wires in the cable.

The width and thickness of the ultimate cable will depend not only upon the number and size of individual conductors present, but also upon the degree to which the composite is compacted. In the latter regard, it will be appreciated that high levels of compaction and conductor packing will produce corresponding levels of metal density, generally with commensurate benefit. In the preferred embodiments, compaction will be effected to produce less than about 15 percent of void space within the cable. While it is not feasible, as a practical matter, to reduce the voids to the zero level, still the cable may undergo greater than 100 percent compaction, which simply means that it is elongated as a result, as may be desirable in some instances to achieve maximum metal density.

On the other hand, it is the high compaction that causes disruption of the conductor coating, the resultant loss of insulation integrity. Hence, provision of the dielectric strip between the layers of wires is found to substantially improve the electrical properties of the cable. Moreover, by affording an opportunity for the introduction of an added element of selective thickness and composition, use of the strip also affords a desirable additional measure of control over those properties.

Although the apparatus and system shown in the drawings is appropriate for use in the manufacture of the cable, variations will undoubtedly occur to those skilled in the art, and are encompassed hereby. For example, while the turkshead roller set shown provides most effective apparatus for compaction of the conductors, virtually any means for developing the necessary force, while maintaining the requisite width and thickness control, may be substituted therefor. Finally, it will be understood that the deformed configuration of the conductors is only suggested in the drawings, and that little effort has been made to reproduce the actual ultimate condition of the core, coating and insulating strip after compaction.

Thus, it can be seen that the present invention provides a novel multi-conductor cable of flat, rectangular cross-section, in which the conductors are helically wound together and compacted into two layers, and in which the individual conductors as well as the layers thereof are well insulated from one another. In the cable, a thin strip of insulating sheet material is interposed between the layers of conductors, to ensure the desired high degree of electrical insulation, and the invention provides a novel method and apparatus by such cable can readily be produced.

Having thus described the invention, what is claimed is:

1. In a method for the manufacture of a flat, rectangular cable comprised of two layers of compacted, helically wound coated conductors and an interposed strip of insulating sheet material, the steps comprising:

(a) continuously supplying to a forming station a longitudinally advancing and rotating generally circular array of at least four coated conductors, and forming the conductors into a helical configuration of circular cross-section;

(b) gradually transforming the cross-section of said array from circular to a flat elliptical configuration;

(c) continuously feeding a strip of insulating sheet material longitudinally into the center of said array of conductors;

(d) comprising said conductors tightly about said insulating strip to transform said elliptical structure into a cable of generally rectangular cross-section in which said conductors are densely packed to provide less than about 15 percent of void space in said cable and are disposed substantially in two layers with said strip interposed therebetween, said strip and the coating on said conductors providing electrical insulation between said layers as well as between the individual conductors; and (e) continuously withdrawing the cable so produced from said forming station.

2. The method of claim 1 wherein said cable is comprised of 7–15 conductors, and wherein said conductors have a core of copper or aluminum.

* * * * *

UNITED STATES PATENT AND TRADEMARK OFFICE

CERTIFICATE OF CORRECTION

PATENT NO. : 4,439,256

DATED : March 27, 1984

INVENTOR(S) : Robert F. Meserve

It is certified that error appears in the above-identified patent and that said Letters Patent are hereby corrected as shown below:

Column 6, line 35, "comprising" should be --compacting--.

Signed and Sealed this

*Twenty-third* Day of *October 1984*

[SEAL]

*Attest:*

GERALD J. MOSSINGHOFF

*Attesting Officer*

*Commissioner of Patents and Trademarks*